US005221151A

United States Patent [19]

Kuo

[11] Patent Number: 5,221,151

[45] Date of Patent: Jun. 22, 1993

[54] MECHANICAL WRITING APPARATUS WITH A MECHANISM FOR RETRACTING PRESHARPENED PENCIL LEAD ELEMENTS

[75] Inventor: Jun-Liang Kuo, 16-1, Lane 24 King-Men St., Taipei, Taiwan

[73] Assignee: Jun-Lian Kuo, Taiwan

[21] Appl. No.: 889,622

[22] Filed: May 28, 1992

[51] Int. Cl.[5] ..... B43K 21/16

[52] U.S. Cl. ..... 401/57; 401/90; 401/94

[58] Field of Search ..... 401/57, 65, 94, 90, 401/112

[56] References Cited

U.S. PATENT DOCUMENTS

| | | | |
|---|---|---|---|
| 3,230,934 | 1/1966 | Eriksson | 401/112 |
| 4,919,556 | 4/1990 | Kuo | 401/90 X |
| 4,966,478 | 10/1990 | Kuo | 401/57 |

FOREIGN PATENT DOCUMENTS

| | | | |
|---|---|---|---|
| 1669 | 2/1886 | United Kingdom | 401/94 |
| 861168 | 2/1961 | United Kingdom | 401/94 |

*Primary Examiner*—Steven A. Bratlie
*Attorney, Agent, or Firm*—Bacon & Thomas

[57] ABSTRACT

A writing apparatus with retractable presharpened pencil lead elements is disclosed having an outer pen holder, an inner cylinder slidably mounted within the outer pen holder, a compression spring to bias the inner cylinder toward an end of the outer pen holder, a pencil lead pushing mechanism to push the lowest pencil lead out of the inner cylinder, a pencil lead clamping mechanism to retain the lowest pencil lead extended beyond the inner cylinder, and a sliding retractor to push away an elastic hook of the pencil lead pushing mechanism in order to retract the extended pencil lead into the inner cylinder. The inner cylinder has a conical flange projected radially to retain the sliding retractor when the elastic hook is pushed away so as to restrain displacement of the inner cylinder and the pencil lead can be retracted into the inner cylinder first. When the sliding retractor is released from the conical flange, the action of the compression spring can retract the inner cylinder completely into the outer pen holder automatically, the elastic hook is completely away from the pencil lead, and resumes its original position.

2 Claims, 5 Drawing Sheets

MECHANICAL WRITING APPARATUS WITH A MECHANISM FOR RETRACTING PRESHARPENED PENCIL LEAD ELEMENTS

BACKGROUND OF THE INVENTION

The present invention relates to an automatic sharpening-free pencil, particularly a non-sharpening pencil with retractable presharpened pencil lead elements.

Conventionally each non-sharpening pencil is composed of a casing with an opening at each end, a plurality of plastic lead holders each fixed with a presharpened pencil lead element stacked in axial alignment within the casing so that, by pushing its top lead holder, the lowest lead holder with a presharpened pencil lead element can be pushed out of the casing for writing purpose. In such a design, the plastic lead holders occupy a considerable space within the casing, and thus the quantity of presharpened pencil lead elements which the casing can hold is limited. Also, the service life of the non-sharpening pencil is shortened. Moreover, the loss of any pencil lead holder will make the whole non-sharpening pencil useless.

U.S. Pat. No. 4,320,982 to Kuo, the inventor of the present application, discloses a writing implement comprising an outer casing, a coil spring disposed within the casing, an inner tube inserted through the coil spring with a plurality of presharpened pieces of pencil lead stored therewithin, and a capping member fitted over an open end of the inner tube. The lower (writing) portion of the inner tube is split into two clamping halves. The lower end of the coil spring is formed into a hook which slides along the slot formed between the clamping halves to allow the expulsion and feeding of presharpened pieces of pencil lead into the space between said two clamping halves. Without any means to retract the presharpened pencil lead into the inner casing, the writing apparatus disclosed by such a writing implement is risky when it is placed with its presharpened pencil lead facing upward or when it is pointing to any person. The presharpened pencil lead may cause injury to the eyes or other important organs.

The U.S. Pat. No. 4,966,478 to Kuo, the inventor of the present application, discloses a writing implement which can have its presharpened pencil lead retracted. By pushing a press portion, an elastic hook means is displaced outwards in order to retract the extended presharpened pencil lead element into the inner cylinder. However, when the press portion is pushed, a stress is concentrated at the junction between the press portion and the elastic hook-means, subjecting the junction to breakage after several pushing movements for retraction of the pencil lead element. Moreover, after retraction of the pencil lead element, the elastic hook means can't resume its original position but remains projected outward in a tensed condition because it is restricted by the lowest presharpened pencil lead element. The tensed condition brings an inner stress at the elastic hook means, and prolonged inner stress will result in elastic fatigue so that the service life of the non-sharpening pencil is shortened. To eliminate the above two defects, the elastic hook means must be made of plastic material with high elastic coefficient to prevent it from breakage due to fatigue caused by prolonged existence of stress. Furthermore, the outward projection of the elastic hook means adversely affects the appearance of the writing apparatus.

SUMMARY OF THE INVENTION

The main object of the present invention is to provide a non-sharpening pencil with a sliding retractor to retract the pencil lead by pushing away an elastic hook means to eliminate the concentrated stress and, hence, prevent breakage of its pencil lead retraction mechanism.The sliding retractor retains the elastic hook means to its original position after retraction of the pencil lead to eliminate inner stress caused by the tensing condition of the outward projected elastic hook means. Consequently, the service life of the nonsharpening pencil is prolonged.

Another object of the present invention is to provide the non-sharpening pencil described above with an elastic hook means made of normal plastic material instead of high tension plastic material as required by the prior art, in order to lower the production cost, and consequently provide more choices of materials for making the non-sharpening pencil so that production can be easily implemented.

Another object of the present invention is to provide a non-sharpening pencil as described above in which its elastic hook means is returned to its original position after retraction of the pencil lead to provide the whole non-sharpening pencil with an improved appearance.

The non-sharpening pencil with the above merits comprises an outer pen holder, an inner cylinder slidably mounted within the outer pen holder, a compression spring to cause the inner cylinder to tend to be displaced upward, a pencil lead pushing mechanism to push the lowest pencil lead out of the inner cylinder, a pencil lead clamping mechanism to retain the lowest pencil lead extended beyond the inner cylinder, and a sliding retractor to push away an elastic hook means of the pencil lead pushing mechanism in order to retract the extended pencil lead into the inner cylinder in order to eliminate concentrated stresses in the course of pencil lead retraction, i.e., the concentration of stress at the junction between the press portion and elastic hook means disclosed in the U.S. Pat. No. 4,966,478 which will result in breakage at the junction. The inner cylinder according to the present invention has a conical flange projecting radially to retain the sliding retractor when the elastic hook means is pushed away, so as to retain displacement of the inner cylinder so that the pencil lead can be retracted into the inner cylinder first. A long slot is designed to limit upward displacement of the inner cylinder. When the sliding retractor is released from the conical flange, the action of the compression spring can retract the inner cylinder completely into the outer pen holder, the elastic hook means is completely away from the pencil lead, and resumes its original position in order to prevent inner stress at the elastic hook means as in the prior art, and to prolong the service life of the writing apparatus according to the present invention.

BRIEF DESCRIPTION OF THE DRAWINGS

Further objects and advantages of the invention will be apparent from a reading of the following detailed description, taken in conjunction with the figures of the accompanying drawings, in which.

DETAILED DESCRIPTION OF THE PREFERRED EMBODIMENT

Figure 1:
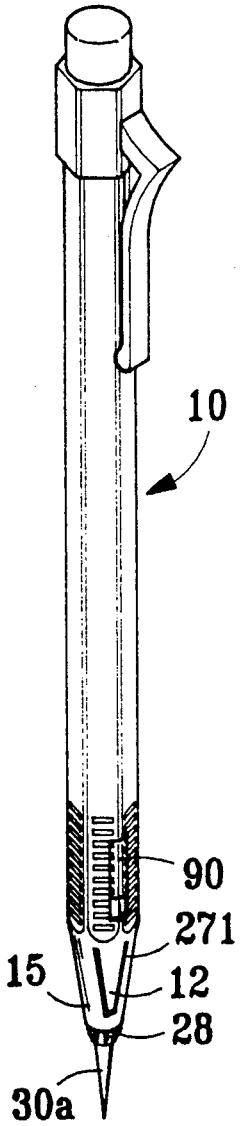
FIG. 1 is a perspective view of a mechanically controlled writing apparatus with presharpened pencil lead elements according to the present invention.
Figure 2:
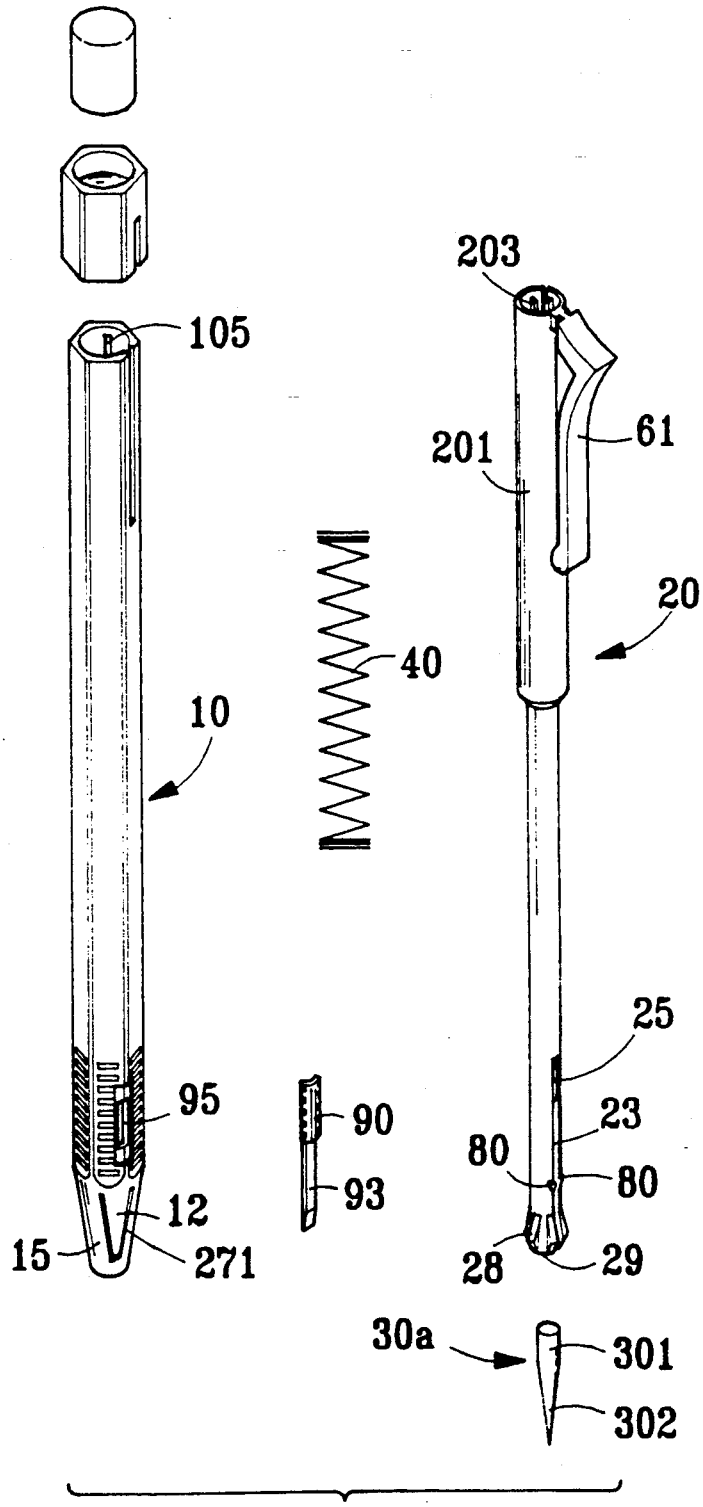
FIG. 2 is a perspective fragmented view of the mechanically controlled writing apparatus with presharpened pencil lead elements according to the present invention.

Please refer to FIGS. 1 and 2, the mechanically controlled writing apparatus with presharpened pencil lead elements comprises an outer pen holder (10); an inner cylinder (20); a compression spring (40); pencil lead pusher composed of an elastic hook means (12), a piercing groove (23) having a shallow groove portion (25), in which the elastic hook means (12) is substantially formed by a V-shaped slit (271) at the reduced front end (15) of the outer pen holder (10); a pencil lead clamping means composed of a plurality of wedge-like projections (28), a reduced outlet (29), and the reduced front end (15); and a sliding retractor (90) to push away the elastic hook means (12). The sliding retractor (90) has a driven suspension foot (93) extending downward for inserting into the outer pen holder (10) through a slot (95) opening through the outer pen holder (10). An appropriate tiny gap is maintained between the suspension foot (93) and the inner wall of the outer pen holder (10). A conical flange (80) projects outwards from the inner cylinder (20) so that the sliding retractor (90) can be retained at the conical flange (80) before it pushes away the elastic hook means (12) in order to restrict displacement of the inner cylinder (20) tentatively, so that the lowest pencil lead element (30*a*) which has been extended out can be retracted fully into the inner cylinder (20). A stop slot (105) is designed to limit upper travel of the inner cylinder (20). When the sliding retractor (90) is released from the conical flange (80), the action of the compression spring (40) retracts the inner cylinder (20) fully into the outer pen holder (10) after retraction of the lowest pencil lead element (30*a*). Then, the elastic hook means (12) resumes its original position for it does not contact the pencil lead element (30).

The outer pen holder (10) and the inner cylinder (20) can be made of ordinary plastic material by an injection forming process. The upper section of the inner cylinder (20) is formed with an enlarged diameter to provide an enlarged section (201). A plurality of equidistant longitudinal ribs (203) are formed on the inner wall surface of the enlarged section (201) in a manner such that the space surrounded by the ribs (203) is just enough to allow passage of the presharpened pencil lead elements (30).

Figure 3:
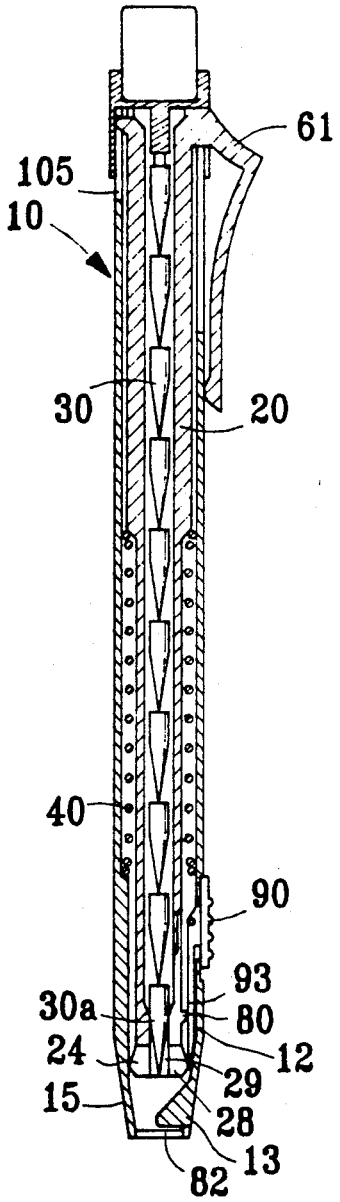
FIGS. 3 thru 5 are longitudinal sectional views illustrating the pushing out of a pencil lead element from the mechanically controlled writing apparatus according to the present invention, in which the inner cylinder is located at an upper dead point position in FIG. 3, the inner cylinder is located at a lower dead point position in FIG. 4, and the inner cylinder is located at a writing position in FIG. 5.
Figure 4:
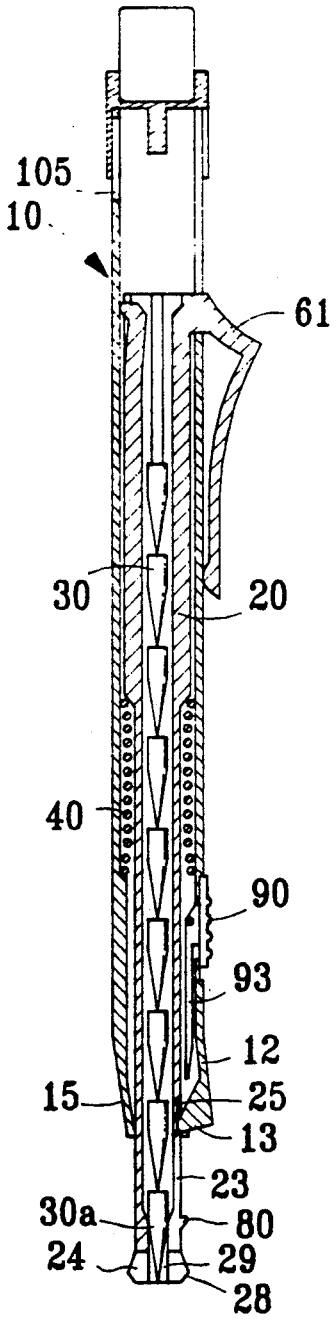
Figure 5:
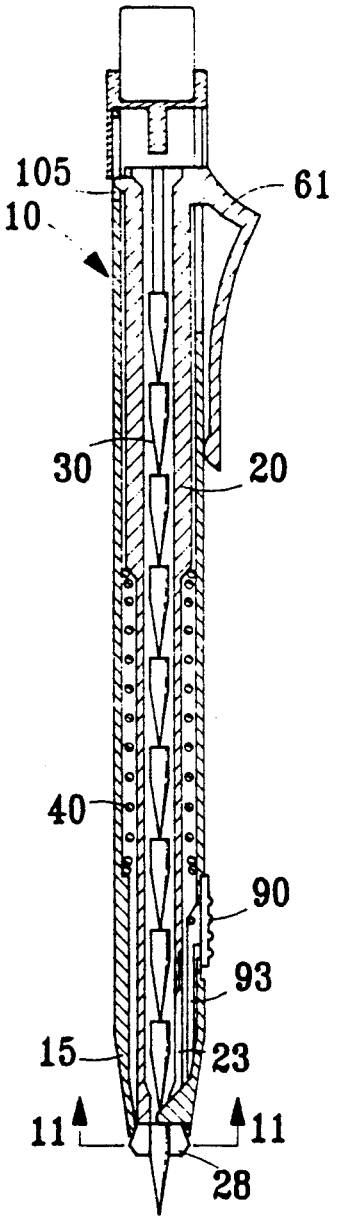
Figure 9:
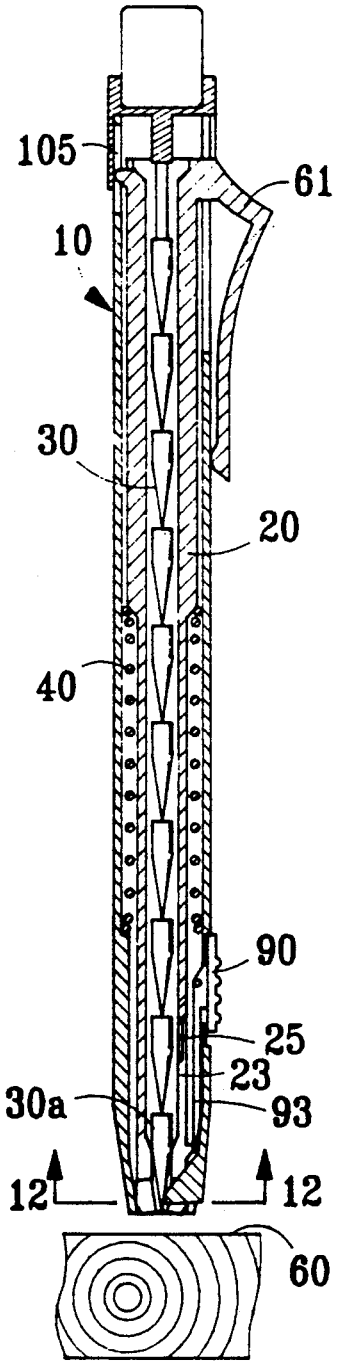

Please refer to FIGS. 3 thru 5 for the pushing action to extend the pencil lead elements (30) according to the present invention. When the inner cylinder (20) is located at an upper dead point as shown in FIG. 3 by tension of the compression spring (40), the hook (13) of the elastic hook means (12) is located beneath the inner cylinder (20) and maintained an appropriate distance from the wedge-like projections (28) with a plurality of presharpened pencil lead elements (30) placed within the inner cylinder (20) in order, while the lowest pencil lead element (30*a*) is prevented from falling out of the inner cylinder (20) by a restriction imposed by the reduced bore of the reduced outlet (29), only the presharpened tip is located within the reduced outlet (29), and the main body of the pencil lead element (30*a*) remains above the reduced outlet (29). Two symmetric piercing grooves (23 and 24), each located at a side of the lower end of the inner cylinder (20), are formed to provide the inner bore of the reduced outlet (29) formed by the wedge-like projections (28) with adequate flexibility. When a pencil clip (61) which is an integrated part of the inner cylinder (20) is pushed downward till the inner cylinder (20) reaches the lower dead point as shown in FIG. 4, the hook (13) is pushed outward by the shallow groove portion (25) to disengage it from the interior of the inner cylinder (20). Then, following the downward displacement of the inner cylinder, the elastic hook means (12) is above the lowest pencil lead element (30*a*). Therefore, by releasing the downward pushing force applied to the inner cylinder (20), the tension of the compression spring (40) causes the inner cylinder (20) to be displaced upwardly. In the course of the upward displacement, the hook (13) enters the interior of the inner cylinder (20) again through the piercing groove (23) to retain the top of the lowest pencil lead element (30*a*) so that the tip of the lower pencil lead element (30*a*) remains out of the reduced outlet (29) while its main body is within the reduced outlet (29) to expand the inner bore of the reduced outlet (29) slightly so that the maximum diameter of the bore surrounded by the wedge-like projections (28) is expanded to become greater than the inner bore of the lower end of the reduced front end (15) of the outer pen holder (10). Then, the wedge-like projections (28) extend out of the lower end (15) of the outer pen holder (10), in the writing position as shown in FIG. 9 after the upward displacement of the inner cylinder (20).

Figure 6:
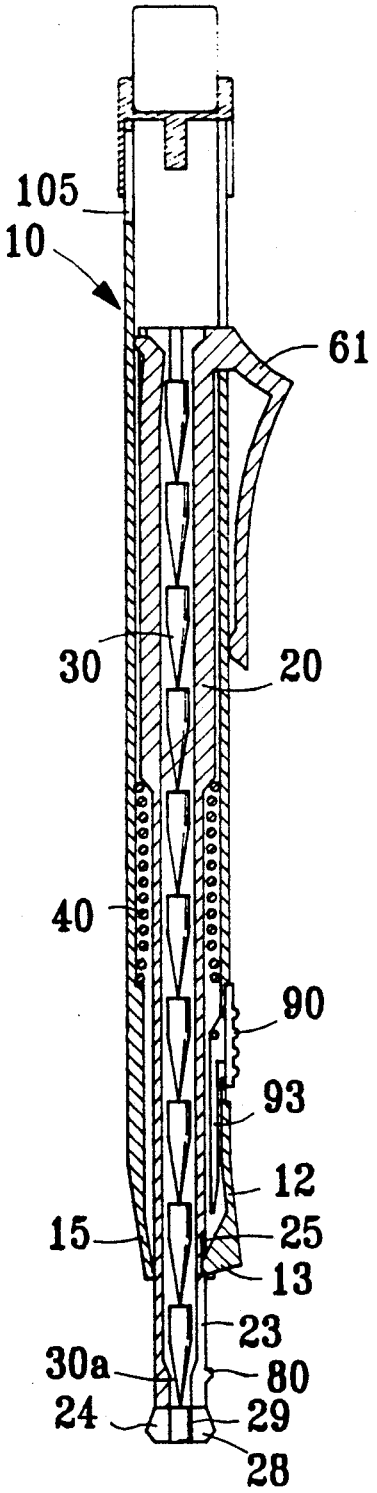
FIGS. 6 and 7 are longitudinal sectional views illustrating replacement of pencil lead elements in the mechanically controlled writing apparatus according to the present invention, in which the inner cylinder is located at a lower dead point position in FIG. 6, and the inner cylinder is located at a writing position in FIG. 7 after replacement of the pencil lead element.
Figure 7:
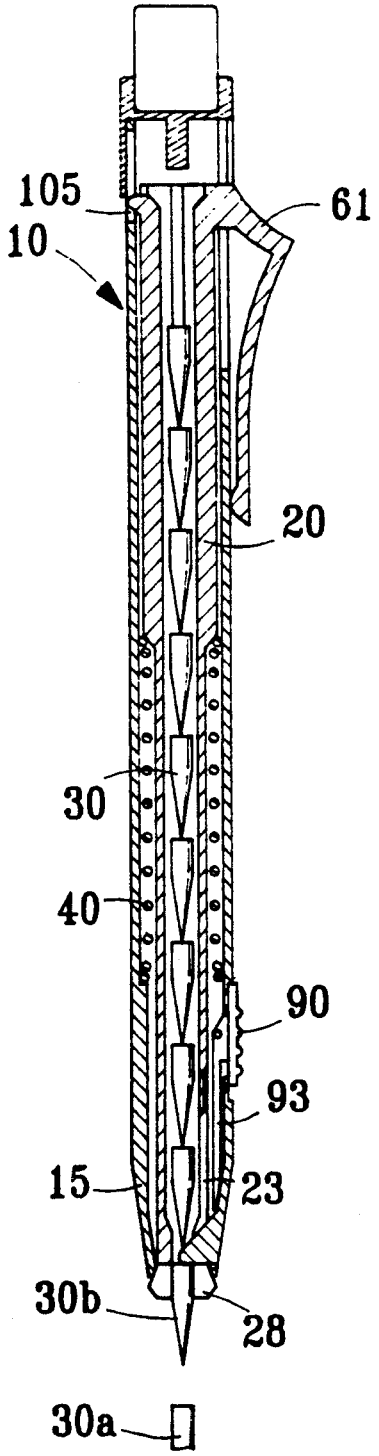

Please refer to FIGS. 6 and 7, whenever replacement of the pencil lead element (30*a*) with another pencil lead element (30*b*) is required due to a dull or broken tip, the replacement process is substantially the same as the pushing process described above, and will not be repeated here.

Figure 8:
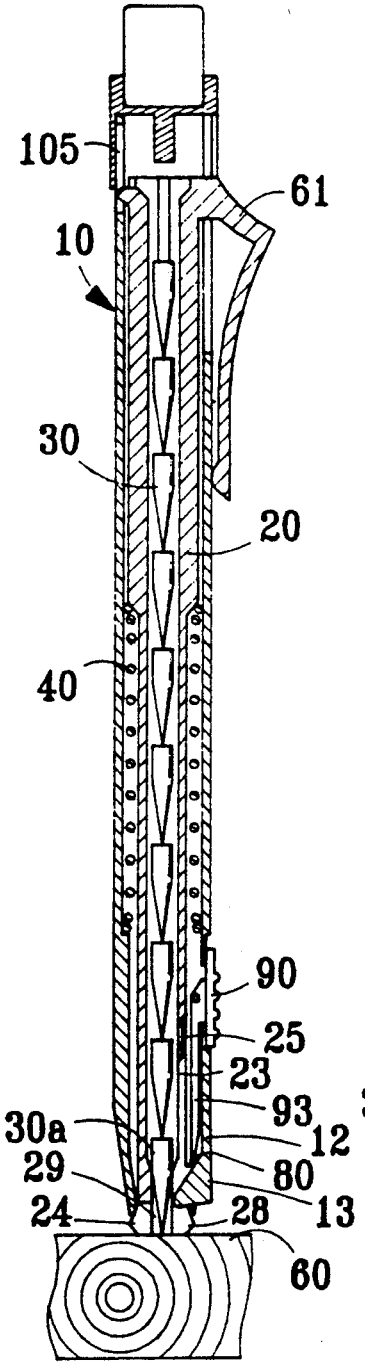
FIGS. 8 thru 10 are longitudinal sectional views illustrating retraction of the lowest pencil lead element in the mechanically controlled writing apparatus according to the present invention, in which the inner cylinder is located with a restricted position in FIG. 8, which is substantially at the writing position shown in FIG. 5, but the same pencil lead element in FIG. 8 has been retracted into the inner cylinder; the inner cylinder in FIG. 9 shows the instance when the wedge-like projections at the lower end of the inner cylinder are passing through the lower opening of the outer pen holder; and the inner pen holder in FIG. 10 is located at the upper dead point position shown in FIG. 3, there is an adequate distance between the lower end of the inner cylinder and the elastic hook means to allow the elastic hook means to return to its original position.
Figure 10:
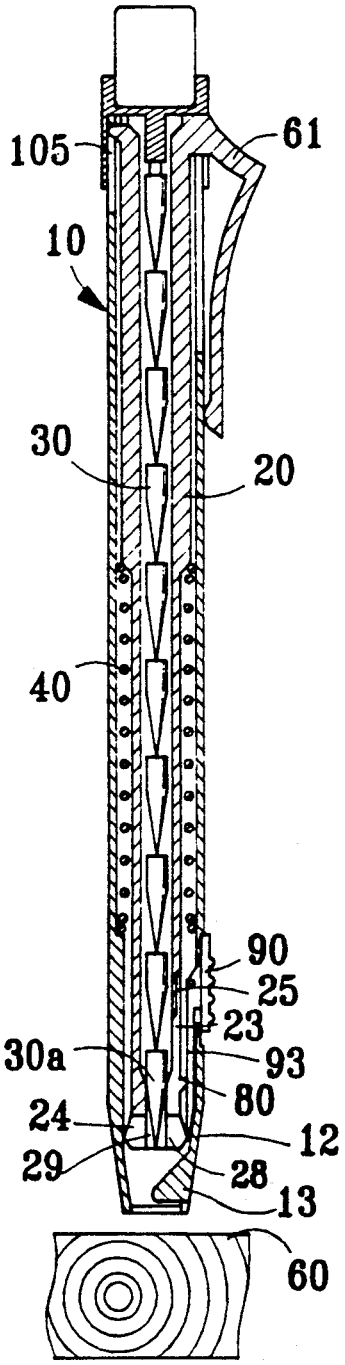

The present invention is an improvement on the prior art. Firstly, it has a sliding retractor (90) to push away the elastic hook means to retract the pencil lead, and eliminate the occurrence of concentrated stresses as happened in the prior art during retraction of the pencil lead. Secondly, the present invention allows full retraction of the inner cylinder (20) into the outer pen holder after retraction of the pencil lead, and allows the elastic hook means (12) to resume its original position by causing the lower end of the inner cylinder to be located above the hook (13). Please refer to FIGS. 8 thru 10. To retract the pencil lead, the sliding retractor (90) is pushed downward, so that the lowest pencil lead element (30*a*) at the writing position as shown in FIG. 5 can be retracted into the inner cylinder (20), and the inner cylinder (20) located at the writing position as shown in FIG. 5 can be retracted into the outer pen holder (10) as shown in FIG. 10 so that the elastic hook means (12) can resume its original position. That is, for retraction of the pencil lead element, only the sliding retractor (90) has to be pushed downward lightly as shown in FIG. 8 so that the suspension foot (93) extending downwardly from the sliding retractor (90) pushes the hook (13) outwards and is retained by the conical flange (80) projected outward from the inner cylinder (20). The whole writing apparatus is lightly pressed against a table surface (60) or other object so that the lowest pencil lead element (30*a*) is completely retracted into the inner cylinder (20) but the inner cylinder (20) is retained in its position, even though the elastic hook means (12) has been pushed away, by the suspension foot (93) of the sliding retractor (90), and only the lowest pencil lead element (30*a*) is subject to reaction from the table surface (60) or such other object. As shown in FIG. 8, after the pencil lead element (30*a*) is completely retracted into the inner cylinder (20), the inner cylinder (20) can, without further touching of the sliding retractor (90), be displaced upwardly rapidly and automatically by action of the compression spring (40). During such upward displacement of the inner cylinder (20), the conical flange (80) on the inner cylinder (20) pushes the suspension foot (93) to the inner wall of the outer pen holder (10) so that it will not obstruct upward displacement of the inner cylinder (20). At the same time, since the lowest pencil lead element (30*a*) has been retracted into the inner cylinder (20), the part remains in the reduced outlet (29) is the tip portion rather than the main body of the pencil lead element (30*a*). Since there are two symmetric piercing grooves (23 and 24) along the wedge-like projections (28) at the lower end of the inner cylinder (20), the bore of the reduced outlet (29) is diminished automatically by the squeezing effect applied by the inner wall of the outer pen holder (10), and consequently the lower end of the inner cylinder (20) which is constituted by these wedge-like projections (28) can pass through the lower opening of the outer pen holder (10) smoothly, as shown in FIG. 9. FIG. 9 illustrates the instance while the inner cylinder (20) is passing through the lower opening of the outer pen holder (10), and finally the inner cylinder (20) is completely retracted into the outer pen holder (10) till the upper dead point as shown in FIG. 10 or 3, i.e., the hook (13) of the elastic hook means (12) is beneath the inner cylinder (20) and resumes its original position. It is different from that disclosed in the U.S. Pat. No. 4,966,478 in which the elastic hook means remains projecting outward in a tense condition afte retraction of the pencil lead element.

Figure 11:
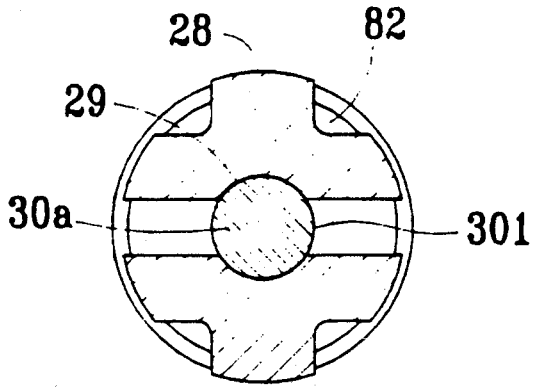
FIG. 11 is a magnified sectional view taken along line 11—11 in FIG. 5, in which the elastic hook means is omitted.
Figure 12:
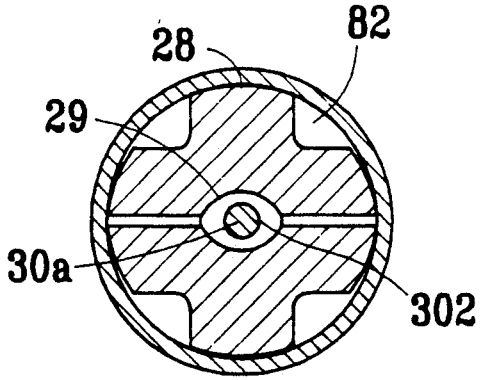
FIG. 12 is a magnified section view taken along line 12—12 in FIG. 9, in which the elastic hook means is omitted.

Please refer to FIGS. 11 and 12 for changes on the bore formed by the wedge-like projections (28) in different states. FIG. 11 is an magnified sectional view taken along line 11—11 in FIG. 5, illustrating the bore while the main body (301) of the pencil lead element (30*a*) remains at the reduced outlet (29)—a bore with larger diameter by squeezing effect of the main body (301) of the pencil lead element (30*a*), which consequently enlarges the outer diameter formed by the wedge-like projections (28) to become greater than the inner diameter of the lower opening (82) of the outer pen holder so that the lower end of the inner cylinder (20) remains extending out of the lower end of the outer pen holder (10), i.e., the writing position as shown in FIG. 5. FIG. 12 is a magnified sectional view taken along line 12—12 in FIG. 9, illustrating the bore while the tip portion (302) of the pencil lead element (30*a*) remains at the reduced outlet (29)—a bore with a smaller diameter by effect of external force applied to the reduced outlet (29), which consequently allows the wedge-like projections (28) to diminish the outer diameter formed by them by a squeezing effect from the inner wall of the lower opening (82) so that it can just pass through the lower opening (82) of the outer pen holder (10) when these wedge-like projections (28) are forced to pass through the lower opening (82) of the outer pen holder (10) by action of the compression spring (40) to resume its position at the upper dead point as shown in FIG. 10.

As described above, the present invention makes use of the sliding retractor to push away the elastic hook means in order to retract the extended pencil lead element into the inner cylinder. It is a structure which can eliminate concentrated stress formed in the retraction of the pencil lead element, such as the stress concentrated at the junction between the press portion and the elastic hook means as disclosed in the U.S. Pat. No. 4,966,478 that makes the junction subject to breakage. Moreover, the present invention can have the elastic hook means resume its original position after retraction of the pencil lead element to eliminate the stress of the elastic hook means be a tensing condition as in the prior art, consequently effectively prolonging the service life of the writing apparatus. The elastic hook means in the present invention can be made of any normal plastic material instead of high tension plastic material to lower production cost, and to eliminate the limitation on material for forming the whole writing apparatus, which consequently permits more choices in the selection of raw material in the production of the writing apparatus.

Having described my invention as related to the embodiment shown in the accompanying drawings, it is my intention that the invention be not limited by any of the details of description, unless otherwise specified, but rather be construed broadly within its spirit and scope as set out in the appended claims.

What is claimed is:

1. A mechanically controlled writing apparatus with retractable, presharpened pencil lead elements comprising:

a) an outer pen holder comprising an elongated generally cylindrical member having a longitudinal axis, a first end defining an opening, a generally "V"-shaped slit adjacent to the first end to form a resilient hook means normally extending generally radially inwardly of the opening and a second end;

b) an inner cylinder slidably located within the outer pen holder and adapted to receive therein a plurality of presharpened pencil lead elements stacked in axial alignment, each with a main body and a tip portion, the inner cylinder defining a pencil lead clamping portion located adjacent to the first end of the outer pen holder and an axially extending slot adapted to allow the resilient hook means to normally extend generally radially into the clamping portion of the inner cylinder;

c) spring means operatively associated with the outer pen holder and the inner cylinder to bias the inner cylinder toward the second end of the outer pen holder;

d) actuating means operatively associated with the inner cylinder and extending exteriorly of the outer pen holder adapted to enable the inner cylinder to be axially moved relative to the outer pen holder between an upper position and a lower position;

e) a shallow groove portion formed on the inner cylinder and located so as to move the hook means out of the clamping portion of the inner cylinder when the inner cylinder is moved to its lower position; and, f) means to prevent the entry of the hook means into the inner cylinder so as to allow a pencil lead element extending therefrom to be retracted back into the inner cylinder comprising a sliding retractor attached to the outer pen holder so as to slide with respect thereto in a direction generally parallel to the longitudinal axis thereof, the sliding retractor including a foot portion adapted to contact the hook means so as to bias the hook means outwardly of the inner cylinder, thereby allowing a pencil lead element extending from the inner cylinder to be retracted into the inner cylinder.

2. The mechanically controlled writing apparatus of claim 1 wherein the actuating means comprises:

a) a stop groove defined by the outer pen holder adjacent to the second end; and, b) a clip member attached to the inner cylinder and extending outwardly of the outer pen holder through the stop groove.

* * * * *